US005109556A

United States Patent [19]

Cook

[11] Patent Number: 5,109,556

[45] Date of Patent: May 5, 1992

[54] CAMP COT WITH ADJUSTABLE TO TENSIONING

[76] Inventor: David G. Cook, S. 4120 Sullivan Rd., Veradale, Wash. 99037

[21] Appl. No.: 665,417

[22] Filed: Mar. 5, 1991

[51] Int. Cl.[5] ..... A47C 17/00

[52] U.S. Cl. ..... 5/110; 5/116

[58] Field of Search ..... 5/115, 117, 118, 110, 5/112, 116, 114

[56] References Cited

U.S. PATENT DOCUMENTS

| | | | |
|---|---|---|---|
| 921,301 | 5/1909 | Stannard | 5/117 |
| 1,151,495 | 8/1915 | Menten | 5/115 |
| 1,518,386 | 12/1924 | Brower | 5/117 |
| 1,929,000 | 10/1933 | Line | 5/112 |
| 2,639,442 | 5/1953 | Herzog | 5/112 |
| 2,991,041 | 7/1961 | Michaelian | 5/110 |
| 3,956,781 | 5/1974 | Reemelin | 5/114 |

FOREIGN PATENT DOCUMENTS

| | | | |
|---|---|---|---|
| 408766 | 1/1945 | Italy | 5/116 |
| 504867 | 12/1954 | Italy | 5/110 |
| 250041 | 5/1948 | Switzerland | 5/116 |
| 552 | 3/1853 | United Kingdom | 5/116 |
| 548751 | 10/1942 | United Kingdom | 5/110 |

*Primary Examiner*—Renee S. Luebke
*Assistant Examiner*—F. Saether

[57] ABSTRACT

A light weight, collapsible, full-size cot with telescoping side rails permanently attached within sleeves at each side of the fabric top, and transverse leg assemblies which support and push apart the side rails by a finely controlled pivoting action to stretch the fabric top to the particular degree of tautness suitable to each cot user.

1 Claim, 4 Drawing Sheets

CAMP COT WITH ADJUSTABLE TO TENSIONING

BACKGROUND

1. Field of Invention

Figure 1:
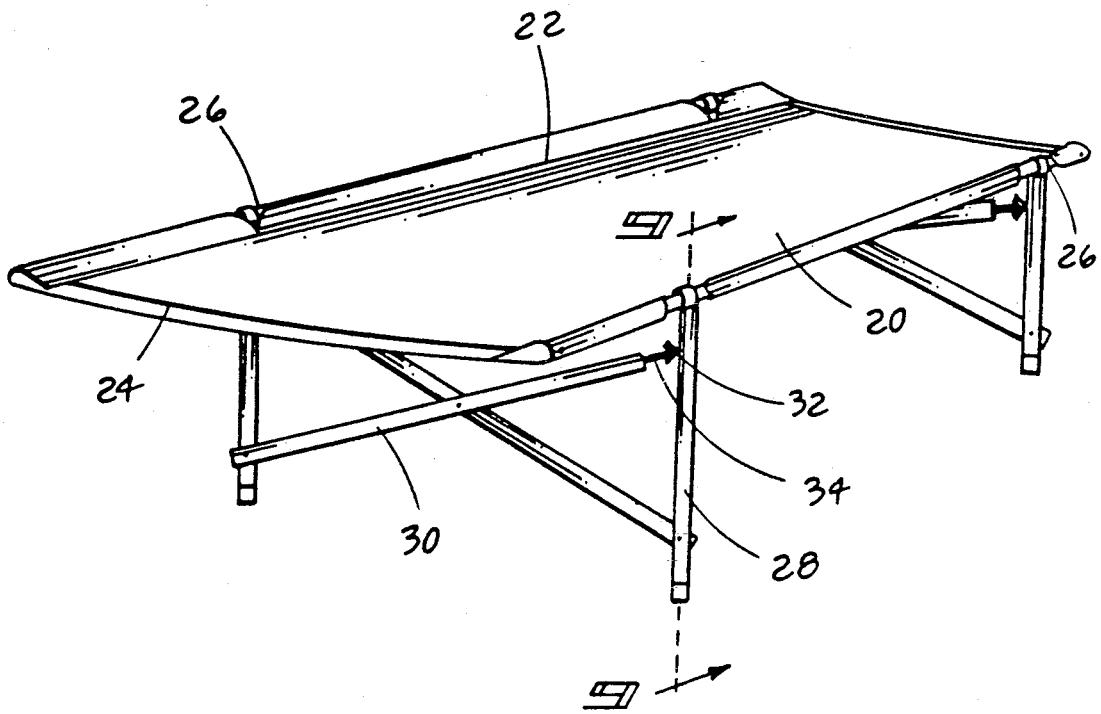

This invention relates to folding or collapsible cots or beds, particularly those used in camping and expeditions.

2. Description of Prior Art

The typical lightweight camp cot consists of three parts:

(1) A rectangular body-support sheet (the top);

(2) A pair of long side rails to hold the sheet; and (3) Two or three transverse leg assemblies to hold the side rails.

The combined weight of these parts is frequently less than ten (10) pounds.

"End bars" are notably absent from the lightweight camp cot. Their cross-bracing function has been assigned to transverse leg assemblies located entirely below the plane of the body-support sheet.

Sleeping comfort on the camp cot is largely dependent on the flatness and firmness of the body-support sheet, which in turn, is dependent on the tensioning force applied to the sheet.

One fixed tension setting cannot satisfy all users because of differences in body weight and personal preferences. For individual comfort, the force applied to tensioning the body-support sheet must be variable, that is, easily adjusted by the user.

Means have been devised to vary tension in the length dimension of the body-support sheet (much as a hammock is stretched from end to end) and also in the short or cross dimension (pulling the body-support sheet from side-to-side.)

Of the two, crosswise tensioning of the body-support sheet appears more suitable for control of sheet flatness.

In pursuit of crosswise tensioning several means have been developed, all adjusting the overall width of the entire transverse leg assembly. By making the transverse leg assembly wider, the distance between side rails is increased and the body-support sheet is stretched tighter.

U.S. Pat. No. 1,929,000 (John M. Line) shows an early example of such crosswise tensioning. The horizontal portion of the transverse leg assembly consists of two overlapping angle irons. One angle iron is provided with a series of spaced slots, and the other with a locking tongue. The cot user places the tongue in a selected slot, hooking the two angle irons together. If the resulting tension on the body-support sheet is inadequate, the whole width of the transverse leg assembly is again increased by the selection of a different slot.

In U.S. Pat. No. 2,639,442 (Eduard Herzoo) the same objective is accomplished by using two horizontal telescoping tubes in a modified U-shaped transverse leg assembly. The larger tube is provided with a series of spaced holes, and the smaller tube with a spring-loaded pin. Tension adjustment consists of selection of a particular hole for the pin to engage.

In U.S. Pat. No. 3,956,781 (Otto M. Reemelin) the whole U-shaped transverse leg assembly is again adjustable in width. However, in this case the two horizontal leg members do not interlock directly, but rather through a shared "central link". Each horizontal leg member has a series of spaced notches, and the central link has a pin at each end to engage the notches. Selecting any two notches to hook on the pins determines the width of the transverse leg assembly.

Two disadvantages become apparent in tensioning a body-support sheet crosswise by altering the entire width of the transverse leg assembly, as is done in the three cases cited above:

1. It is inconvenient for the user to adjust tension. The user must turn the cot over or on its side, release locking devices, relocate horizontal members against fabric resistance, and lock the members again in a new position.

2. It is impossible for the user to vary tension except in the fixed increments provided by the manufacturer's spacing of slots, holes, or notches. There is no allowance for "fine tuning".

In addition, there is a generic weakness in many cots with lightweight, flexible transverse leg assemblies: To the eye of the user, a flat-appearing body-support sheet may seem like an ideal bed, but, when body weight is applied, the body-support sheet sags, and further adjustment is necessary.

Thus, while crosswise tensioning is such a promising concept, means have been lacking to make it convenient, finely-adjustable and accurately predictable.

OBJECTS AND ADVANTAGES OF MY INVENTION

Accordingly, my invention is intended (1) to provide a convenient means for obtaining fine variations of crosswise tension in the body-support sheet of a collapsible cot or bed; (2) to incorporate this means as an integral part of each transverse leg assembly so that the leg assemblies, once adjusted for desired body-support sheet tension, will hold the side rails rigidly apart to maintain the tension, and at the same time, hold the body-support sheet at a convenient seating height (at least 15") off the ground; (3) to supplement the adjustable holding action of the leg assemblies with side rails which can safely withstand a high degree of tension in the body-support sheet; and (4) for efficient storage, to allow the disassembled cot with leg assemblies and side rails enclosed and protected by the fabric of the body-support sheet to be rolled up as a compact bundle of small diameter and of a length somewhat less than half the length of the assembled cot.

Further objects and advantages of the invention may be found by consideration of the ensuing description and the accompanying drawings.

DRAWING FIGURES

FIG. 1: Perspective view of cot embodying invention

Figure 2:
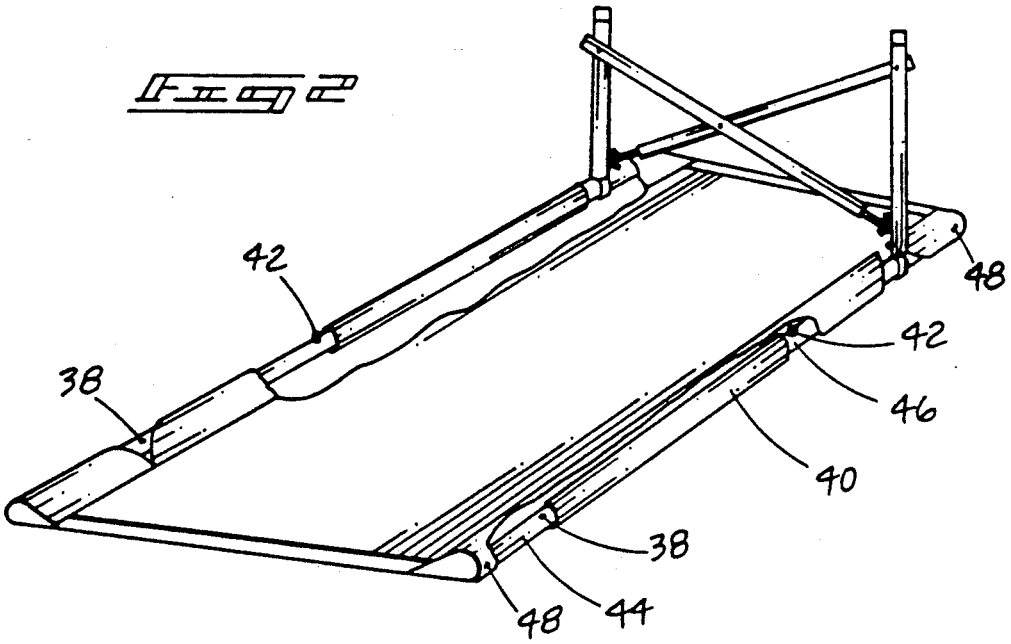

FIG. 2: Perspective view of inverted cot, with one transverse leg assembly removed and a portion of the body-support sheet cut away from each side rail FIG. 3: Side Elevation of side rail with movable rail member in the "in use" position FIG. 4: Side Elevation of side rail with movable rail member in the "stored" position FIG. 5: Side Elevation in cross section of left-hand stationary rail member FIG. 6: Side Elevation of transverse leg assembly in its "stored" mode FIG. 7: Side Elevation of transverse leg assembly spread out, midway between "stored" and "in use" modes FIG. 8: Side elevation of transverse leg assembly in its "in use" mode FIG. 9: Cross section of area where transverse leg assembly attaches to side rail along lines shown in FIG. 1 (Minimum tension configuration.)

Figure 10:
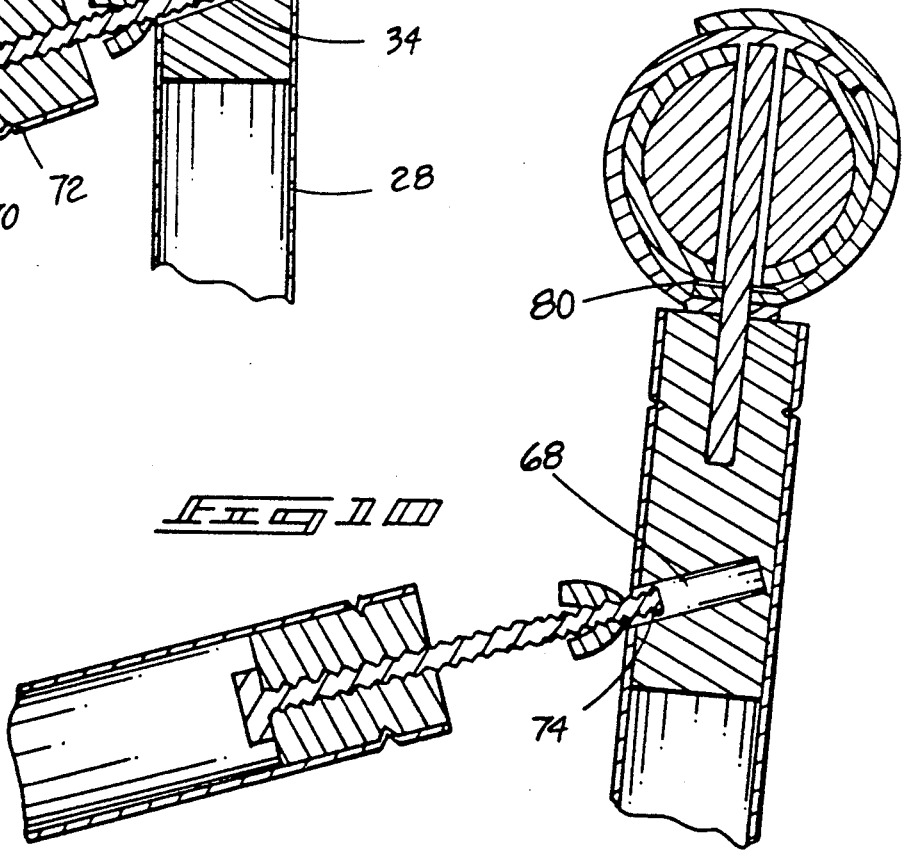

FIG. 10: Cross section of same area where transverse leg assembly attaches to side rail along lines shown in FIG. 1 (Maximum tension configuration.)

DESCRIPTION OF MY INVENTION IN ITS PREFERRED EMBODIMENT

FIG. 1 shows the cot ready for use, with the rectangular body-support sheet (20) fully spread out. Hemmed edges (22) in the long dimension of the sheet form sleeves which envelop telescoping side rails and distribute crosswise tensioning forces evenly through the sheet. Smaller hemmed edges (24) in the short dimension conceal the ends of the side rails.

Four V-shaped fabric cutouts (26) in the sleeves of the body-support sheet give access to side rails in the four areas where they attach to transverse leg assemblies.

Two transverse leg assemblies support the side rails. Each transverse leg assembly has two vertical legs (28) which are shown here tilted approximately five degrees from the perpendicular, an indication that the body-support sheet is sustaining considerable tensioning force.

The tensioning force is applied by tensioning wing nut (32) on tensioning screw (34), both located at the top of the diagonal brace (30). As shown here, the tensioning wing nut is located near the top of the tensioning screw. This position, in which the wing nut is moved as far as possible away from the top of the diagonal brace, is the maximum tension setting for the variable tensioning means.

The diagonal braces are angled approximately seventy degrees from vertical legs, an angle that eliminates any possible contact between diagonal braces and the user's head and feet.

FIG. 2 shows the cot inverted, with one transverse leg assembly removed and portions of the body-support sheet cut away to reveal portions of both side rails.

As observed from the near side, the telescoping side rail is seen to consist of a short left-hand stationary rail member (44) fastened to the body-support sleeve by alignment screw (48), a long right-hand stationary rail member (46) also fastened to the body-support sheet by an alignment screw (48), and a movable rail member (40) overlapping the two stationary members and pushed against the fixed stop (42).

Each leg attachment receptacle (38) is approximately in the middle of a V-shaped fabric cutout, a position maintained by the alignment screws. Only when the movable rail member is positioned against its stop is the leg attachment receptacle in the short stationary rail member exposed for attachment of the transverse leg assembly.

The V-shaped fabric cutouts allow the movable rail members to be reached and manipulated, but only when transverse leg assemblies are not attached to side rails. As soon as transverse leg assemblies are attached to side rails, the side rails are locked so that their members can no longer slide over each other.

Movable rail members are not located exactly opposite each other, but are offset, with short stationary rail members located at diagonally-opposite corners of the body-support sheet. The staggered placement of the relatively large-diameter movable rail members smooth the fabric of the body-support sheet.

Figure 3:
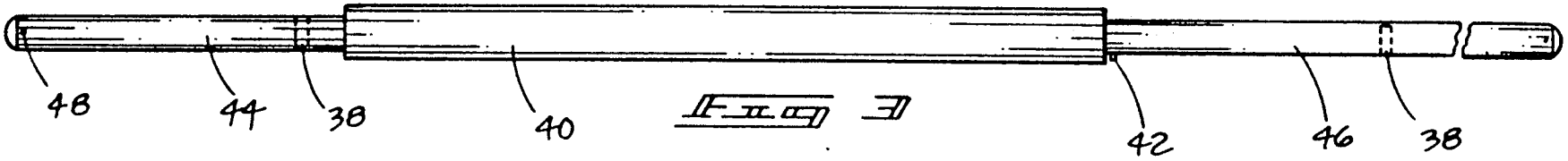
Figure 3A:
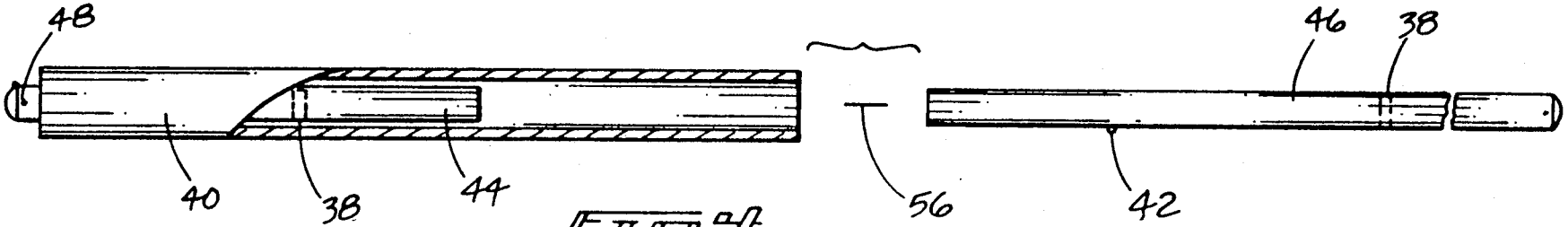

FIG. 3 is, in larger scale, a side elevation of the telescoping side rail, with the movable rail member in its "in use" position, bridging the distance between short and long stationary rail members and touching the stop on the long right-hand stationary rail member. The leg attachment receptacle in the left-hand stationary rail member has been cleared by the movable rail member so that there is now enough space available for attachment of the transverse leg assembly to the side rail.

FIG. 4 is a side elevation of the telescoping side rail with the movable member in its extreme left-hand or "stored" position. Here it envelops the left-hand stationary rail member and covers the leg attachment receptacle.

When the movable rail members in both telescoping side rails are in their "stored" positions, they leave a substantial gap (56) in both sleeves of the body-support sheet, providing a side-to-side area free of any structural parts. This unobstructed belt across the middle of the body-support sheet makes it easy to fold the sheet, with side rail members enclosed, into half its former length.

The folded sheet, now doubled in fabric thickness, is then rolled into a bundle containing all structural parts (side rail members and transverse leg assemblies), the fabric formerly at the centerline area is pushed over the ends of the structural members to protect them and to reduce the length of the compact bundle to less than half the length of the assembled cot.

Figure 5:
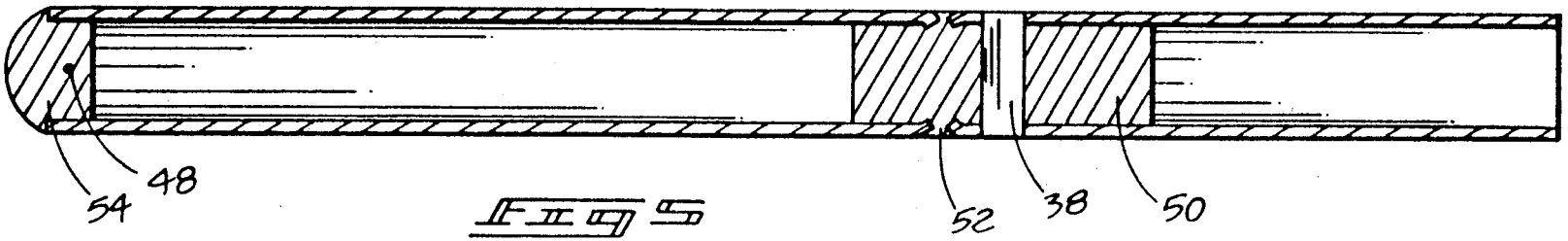

FIG. 5 is a cross section of the left-hand stationary rail member. Dowel (50) is staked at points (52), and the stationary rail member is drilled from top to bottom to provide leg attachment receptacle (38).

A round plug (54) prevents the end of the stationary member from damaging the fabric sleeve. The fabric alignment screw, which penetrates both rail member and plug, fastens the end of the sleeve of the body-support sheet to the end of the rail member. Each of the four stationary rail members is attached to the body-support sheet in a similar manner.

Figure 6:
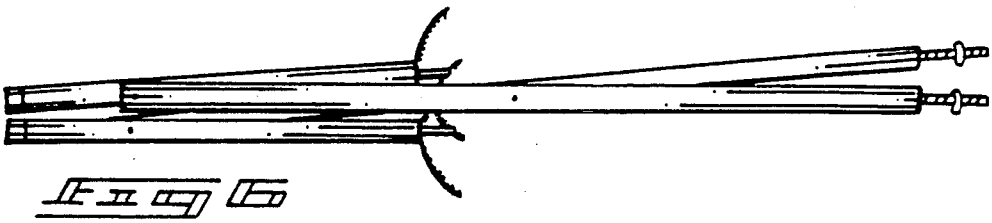

FIG. 6 shows the transverse leg assembly, folded together, with its four tubular members nested in near-parallel position. In this mode, the transverse leg assembly is compacted for roll-up within the body-support sheet.

Figure 7:
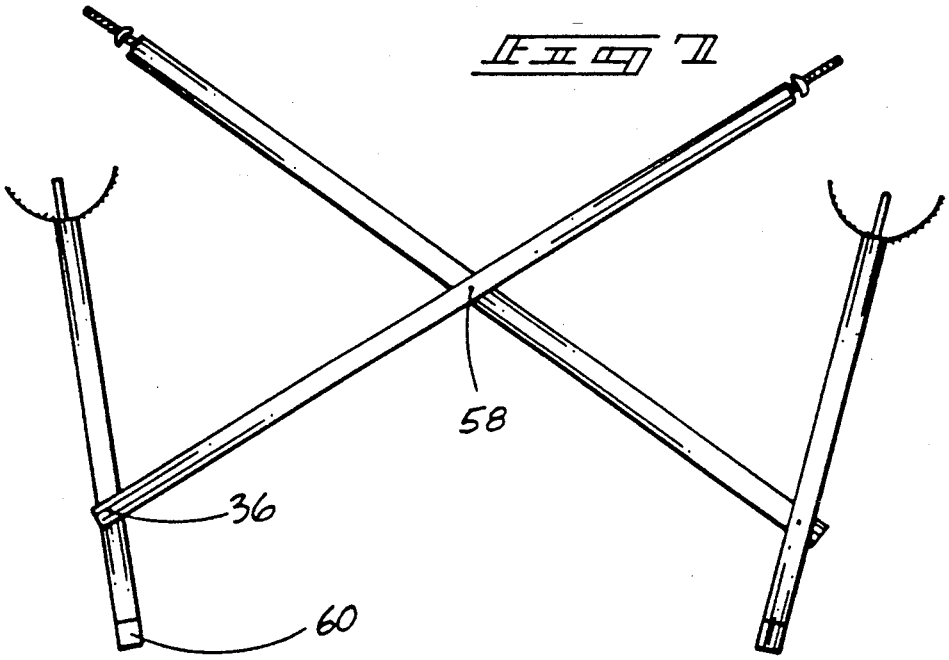

FIG. 7 shows the same transverse leg assembly folded out, but with vertical legs not yet joined to diagonal braces. Each diagonal brace is pivotally attached at its lower end to a point near the lower end of a vertical leg by pivot rivet (36). The two diagonal braces are also pivotally attached to each other approximately at their midpoints by pivot rivet (58). Bottom ends of vertical legs are protected by end caps (60).

Figure 8:
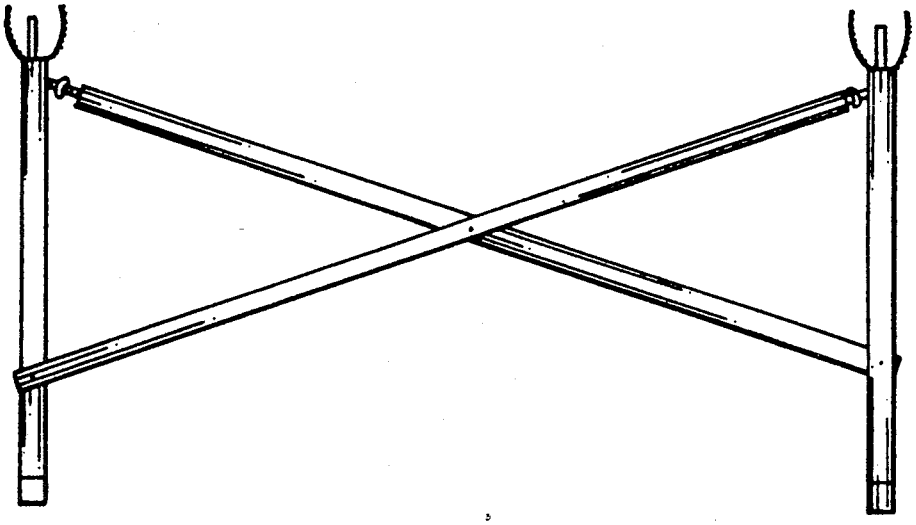

FIG. 8 shows the transverse leg assembly completely assembled. Vertical legs are parallel with each other and perpendicular to the ground. This is the configuration in which tops of legs are close enough to each other to allow the transverse leg assembly to be attached easily to both side rails.

Figure 9:
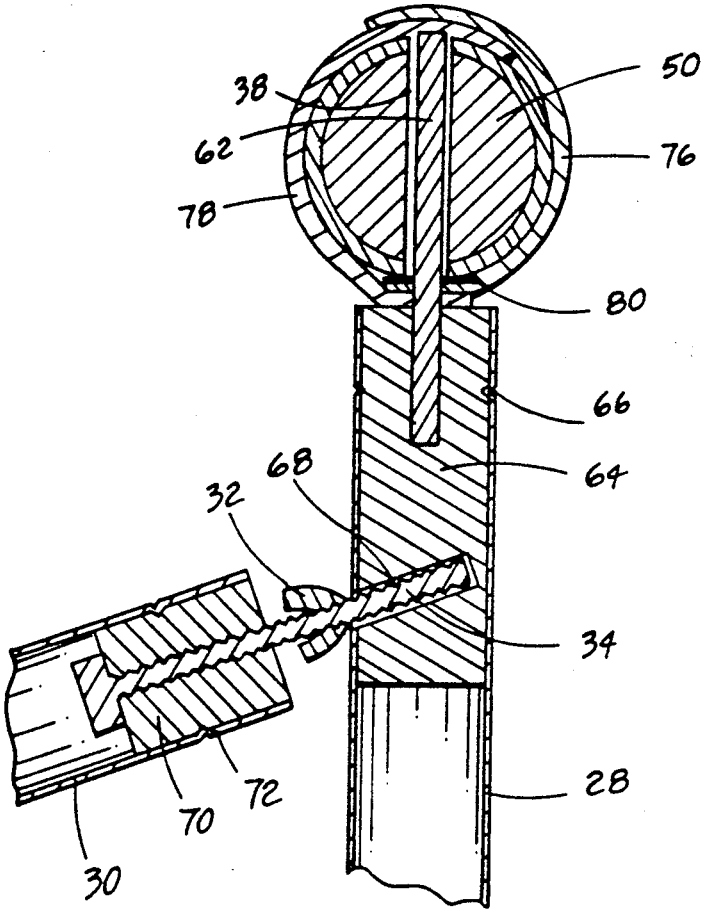

FIG. 9 shows in larger scale and in cross section the area where the top of a vertical leg attaches to a stationary rail member of the side rail and also where the top of a diagonal brace meets and joins the vertical leg. The vertical leg here is approximately perpendicular to the ground, and if the body-support sheet were shown, it would be in minimum tension.

Tensioning screw (34) is anchored inside the diagonal brace by diagonal brace dowel (70), and the dowel is held in place by staking points (72).

Tensioning wing nut (32) is shown near the low end of the tensioning screw, and the tensioning screw is fully inserted in tensioning screw well (68).

A long vertical leg dowel (64), inserted at the top of the vertical leg, is held in place by staking points (66). This dowel is drilled in two places: (1) directly in the middle of the dowel, on the long axis of the vertical leg, to hold leg attachment stud (62) which projects far enough from the top of the vertical leg to penetrate completely the leg attachment receptacle in the stationary member of the side rail; (2) from the side of the leg and near its top, at an approximate seventy-degree angle from the long axis of the leg, to provide the tensioning screw well.

The tensioning screw well in the preferred embodiment does not penetrate both sides of the vertical leg. However, an alternate approach, allowing the use of a longer tensioning screw and even greater tensioning of the body-support sheet, would be to penetrate both sides of the vertical leg, turning the well into an open shaft.

Flexible Velcro straps, fastened to the top of the vertical leg, hold the side rail and leg together during assembly and then cushion the top of the leg attachment stud for the cot user's comfort. Both Velcro straps, hook section (76) and loop section (78) are punched to fit over the leg attachment stud, and are held in place by retainer washer (80). The hook and loop sections mate at the top of the side rail, directly over the end of the leg attachment stud.

FIG. 10 shows in cross section the same area as that in FIG. 9, but differs in three respects: (1) the vertical leg is tilted approximately five degrees from the perpendicular; (2) the tensioning wing nut is located near the top end of the tensioning screw [stopped from running off the screw by upset threads at stop (74)]; (3) only a limited portion of the tensioning screw is still retained in the tensioning screw well, to maintain connection between vertical leg and diagonal brace. Under these conditions the body-support sheet is at maximum tension.

OPERATION OF INVENTION

This lightweight (9 lb., 4 oz.) camp cot stores in a space less than 36" long and 5" in diameter, and no tools are needed for set up.

The body-support sheet, with side rail members trapped within fabric sleeves, unrolls to free the two transverse leg assemblies. When the sheet is unfolded once and spread on the ground, the user has only three steps to put the cot into use:

1. Telescope side rails.
2. Attach transverse leg assemblies to side rails.
3. Adjust tension.

Telescoping the side rails together is accomplished by sliding each movable rail member to the right until it touches its right-hand stop, at which point the movable rail members overlap each stationary member equally and the side rails have become unified assemblies.

Leg assemblies are folded out and joined so that tensioning screws penetrate tensioning screw wells. With tensioning screw nuts turned close to the tops of diagonal braces, attachment studs of the transverse leg assemblies are easily plugged into side rails.

At this point the leg assemblies function also as left-hand stops to lock the movable rail members to their respective stationary members.

Velcro straps are pulled around side rails and gripped together on the tops of the rails. This insures that the rails and legs do not pull apart while the cot is being turned right side up prior to tensioning.

Once the cot is resting on its leg assemblies, the four wing nuts are turned until the user's preference for body-support sheet flatness and firmness is exactly met.

The tensioning means for this cot are the controlled pivotal movement of legs at their attachment points to diagonal braces.

Fine gradations in tensioning force are possible because each full turn of a wing nut adds only a fraction of an inch of distance between side rails.

The wing nuts are easily turned because of the large mechanical advantage obtained from wing nuts with relatively wide "wing span" and tensioning screws with many threads to the inch.

Total travel of wing nuts on tensioning screws angles the legs approximately five degrees outward, and allows tension adjustment in the body-support sheet catenary from loose to taut.

I claim:

1. A lightweight, collapsible cot comprising a body-support sheet, side rails to which said body-support sheet is attached and a plurality of transverse leg assemblies to support and position said side rails, means to adjust in infinitely-fine increments a cross-tension on said body-support sheet from loose to taut by moving apart said side rails, said means comprised of a four member leg assembly consisting of two vertical legs and two adjustable-length diagonal braces in which the lower ends of said adjustable-length diagonal braces are pivoted to the lower ends of said vertical legs, both said adjustable-length diagonal braces are pivoted to each other near their midpoints, and both said adjustable-length diagonal braces are connected at their top ends to the top of said vertical legs through adjustable joints, such that, as said adjustable-length diagonal braces are gradually lengthened, the tops of said vertical legs are gradually spread apart, moving said vertical legs out of parallel with each other thereby increasing tension on said body-support sheet.

* * * * *